United States Patent [19]

Schuck et al.

[11] 4,119,157

[45] Oct. 10, 1978

[54] CONTROL FOR CABLE PLOWS AND THE LIKE

[75] Inventors: Paul R. Schuck, Davenport; John M. Baylor, Bettendorf, both of Iowa

[73] Assignee: J. I. Case Company, Racine, Wis.

[21] Appl. No.: 836,927

[22] Filed: Sep. 26, 1977

Related U.S. Application Data

[63] Continuation of Ser. No. 648,347, Jan. 12, 1976, abandoned.

[51] Int. Cl.[2] ..... E02F 5/02; F16L 1/02

[52] U.S. Cl. ..... 172/477; 172/699; 405/181; 405/182

[58] Field of Search ..... 61/72.1, 72.5, 72.6; 37/98, 193; 172/667, 673, 741, 742, 699, 477

[56] References Cited

U.S. PATENT DOCUMENTS

| | | | |
|---|---|---|---|
| 3,140,745 | 7/1964 | Hinkle et al. | 172/742 X |
| 3,232,358 | 2/1966 | Heiberg | 172/742 |
| 3,515,222 | 6/1970 | Kant | 61/72.6 X |
| 3,559,415 | 2/1971 | Vaughan et al. | 61/72.6 |
| 3,571,956 | 3/1971 | Heiberg | 37/98 |
| 3,670,825 | 6/1972 | Asal et al. | 172/742 X |
| 3,952,532 | 4/1976 | Spearman | 61/72.6 X |

FOREIGN PATENT DOCUMENTS

| | | | |
|---|---|---|---|
| 1,231,599 | 9/1960 | France | 172/742 |

*Primary Examiner*—Mervin Stein
*Assistant Examiner*—David H. Corbin
*Attorney, Agent, or Firm*—Cullen, Sloman, Cantor, Grauer, Scott & Rutherford

[57] ABSTRACT

A control mechanism for adjusting the angle and lateral position of a plow blade, which is particularly useful for laying cable, pipe and the like underground. The disclosed control mechanism includes a fixed frame, which is supported on a suitable vehicle and a slide frame, which supports the plow blade. The slide frame is slideably supported on a horizontal rail of the fixed frame. A piston or other power means is connected to the fixed and slide frames to adjust the lateral position of the supported plow blade. The disclosed plow includes a support frame which is pivotally mounted on a vertical pivot on a slide frame and the control mechanism includes means to angularly adjust the blade on the pivot.

5 Claims, 10 Drawing Figures

28
30
5
5

FIG. 10
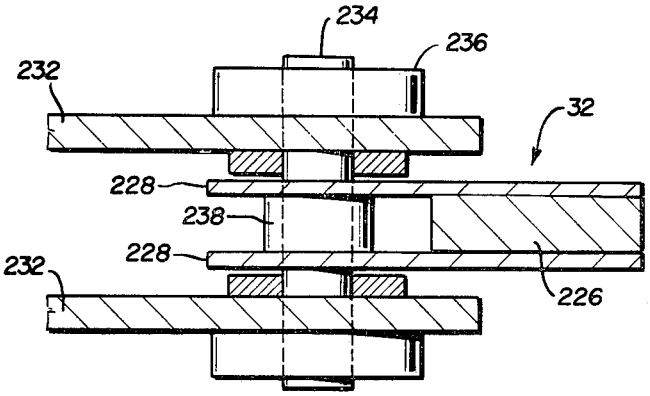
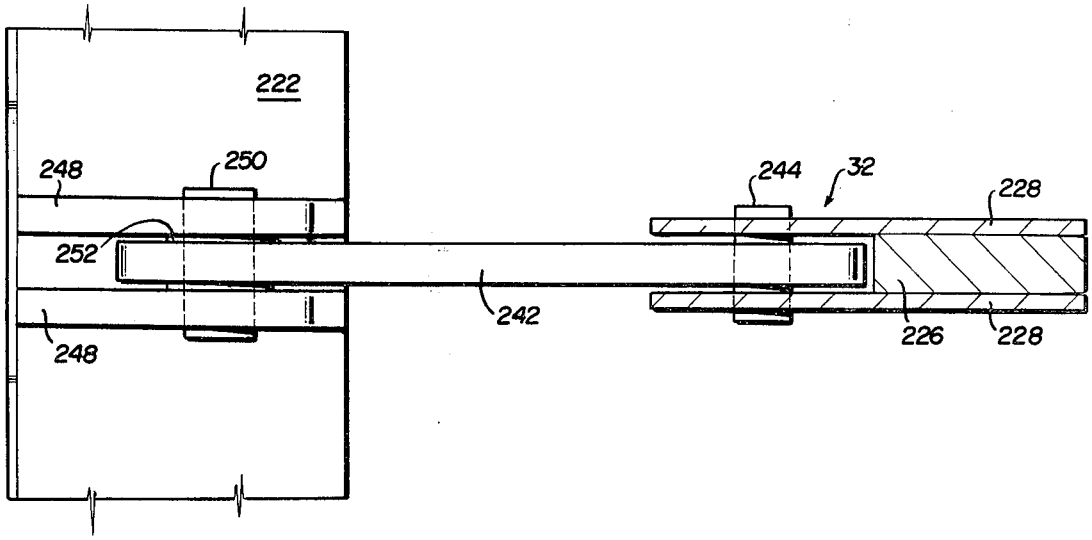
FIG. 9

CONTROL FOR CABLE PLOWS AND THE LIKE

This is a continuation division of application Ser. No. 648,347, filed Jan. 12, 1976, now abandoned.

FIELD OF THE INVENTION

The disclosed invention relates generally to control mechanisms for plows. The plow of this invention may be utilized to lay a continuous length of cable underground at the desired depth. More particularly, the control mechanism of this invention is utilized to adjust the angle and lateral position of a plow blade.

DESCRIPTION OF THE PRIOR ART

Plows of the type disclosed having an elongated vertical blade in the longitudinal axis of the prime mover or vehicle have been used for several years to lay cable, flexible pipe, etc. The cable or pipe may be either drawn through the cut of the plow blade or a cable guide or chute may be provided on the trailing edge of the blade which guides the cable into the ground from a drum mounted on the prime mover. More recently, various types of vibrators or shakers have been mounted on the plow blade or supported on the frame which effectively reduces the drawbar pull or force required to pull the blade through the ground, such as disclosed in U.S. Pat. No. 3,363,423. The plow blade is generally rigidly mounted on the supporting frame in the longitudinal axis of the prime mover limiting use of the cable laying plow to applications where there is access for the prime mover. Side mounted plow assemblies have been proposed for difficult applications, however the need remains for a control for adjusting the angle and lateral position of a cable laying plow which provides suitable support for the plow blade, particularly for vibratory cable laying plows.

The control for cable laying plows and the like of this invention permits remote control of the angle and lateral position of the plow blade, which has not been successfully accomplished in prior devices. The plow blade may therefore be caused to track to different positions with respect to the longitudinal axis of the prime mover, increasing the application of cable laying plows in underground installations.

SUMMARY OF THE INVENTION

As described, the plow of this invention includes a prime mover and an elongated plow blade mounted on a blade support, which is particularly suitable for laying cable, pipe or the like underground. The cable laying plow may also include a vibrator or shaker to reduce drawbar pull and a cable guide on the trailing edge of the blade to feed cable, flexible pipe, etc. into the cut of the plow blade. The vehicle or prime mover may be a conventional bull-dozer or tractor and the blade may be supported on a vibration isolating frame, such as disclosed in U.S. Pat. No. 3,618,237, which is incorporated herein by reference.

The improved control and plow positioning assembly of this invention includes a relatively fixed frame assembly supported on the prime mover or vehicle and a slide frame assembly which supports the plow blade and the blade support assembly. The fixed frame assembly includes a generally horizontal rail which is transverse to the axis of the vehicle and the slide frame assembly is slideably mounted and supported on the fixed frame rail. A power means, preferably a remotely controlled piston assembly, is connected between the fixed and slide frame assemblies which is activated to laterally position the plow blade relative to the vehicle. In the preferred embodiment, the support for the plow blade is pivotally connected to the slide frame assembly on a generally vertical pivot. A pivot means is connected between the slide frame and the blade support which is adapted to pivotally rotate the plow support on the pivot to adjust the angular relation of the blade relative to the vehicle. In the disclosed embodiment of the control and plow positioning assembly, the pivot means comprises two angularly related pistons which are each pivotally connected to the slide frame and the plow support assembly, whereby the angular position of the blade may be remotely controlled by actuation of the pistons.

The disclosed embodiment of the fixed frame assembly includes two vertically spaced parallel rails which are defined on the top and bottom edges of a vertical plate and the slide frame assembly includes opposed hook-shaped elements slideably engaging the top and bottom edges of the support plate, supporting the slide frame assembly for lateral shifting of the plow blade. This assembly provides excellent support for a cable laying plow, particularly a vibratory cable laying plow and permits the plow blade to track laterally with respect to the longitudinal axis of the vehicle or prime mover. Further, the lateral position of the blade may be remotely controlled from the vehicle, increasing the application of cable laying plows for underground installation of cables, flexible pipe and the like. For example, the position of the plow blade may be controlled to avoid obstacles such as underground rocks, etc. and the vibratory cable laying plow may be utilized to lay cable along the side of roadbeds, etc.

Other advantages and meritorious features of the present invention will be more fully understood from the following description of the preferred embodiments, the appended claims and the drawings, a brief description of which follows.

BRIEF DESCRIPTION OF THE DRAWINGS

FIG. 9 is a partial cross-sectional bottom view of the linkage shown in FIG. 8, in the direction of view arrows 9—9; and FIG. 10 is a top partially cross-sectioned view of the connection between the plow blade and the frame assembly shown in FIG. 8, in the direction of view arrows 10—10.

DESCRIPTION OF THE DRAWINGS AND PREFERRED EMBODIMENTS

Figure 1:
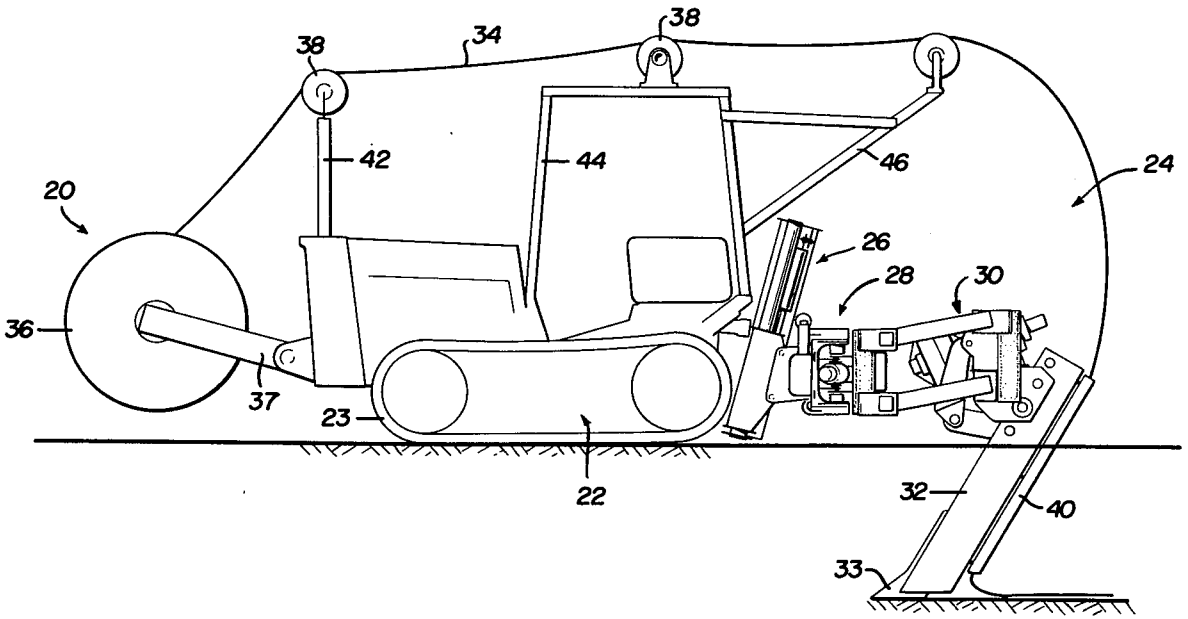
FIG. 1 is a side elvation of one embodiment of a vibratory cable laying plow which includes the present invention.

The embodiment of the cable-laying plow shown in FIG. 1 generally includes a prime mover 22 and a vibratory plow assembly 24. It will be understood that the prime mover may be any suitable vehicle, including bulldozers, tractors and the like. The disclosed embodiment of the prime mover tory plow assembly includes a mast assembly 26, an adjustment mechanism 28, a blade support or frame 30 and an elongated blade 32. As described, the mast assembly 26 is adapted to raise, lower and adjust the tilt or cant angle of the blade 32 relative to true vertical. The control mechanism 28 is adapted to adjust the lateral position and angle of the blade 32 relative to the longitudinal axis of the prime mover 22 and the blade support or frame 30 is adapted to vibrate the bulldozer blade and transmit an arcuate or orbital motion to the blade tip or toe 33.

As described above, the cable-laying plow of this invention may be utilized to lay cable, flexible pipe or hose underground. It will be understood that the term cable is used herein as a generic term. In the disclosed embodiment of the cable-laying plow, the cable 34 is received from a drum 36 rotatably supported on a suitable boom 38 of the prime mover 22. The cable is then received on reels 38, over the prime mover and the cable is then fed through a guide or cable chute 40 into the cut made by the plow blade 32. The reels 38 in the disclosed embodiment are supported on a forward mast 42, the bulldozer canopy 44 and a rearward mast assembly 46. The mast assembly 26, control 28 and blade support or frame 30 will now be described in detail.

Figure 2:
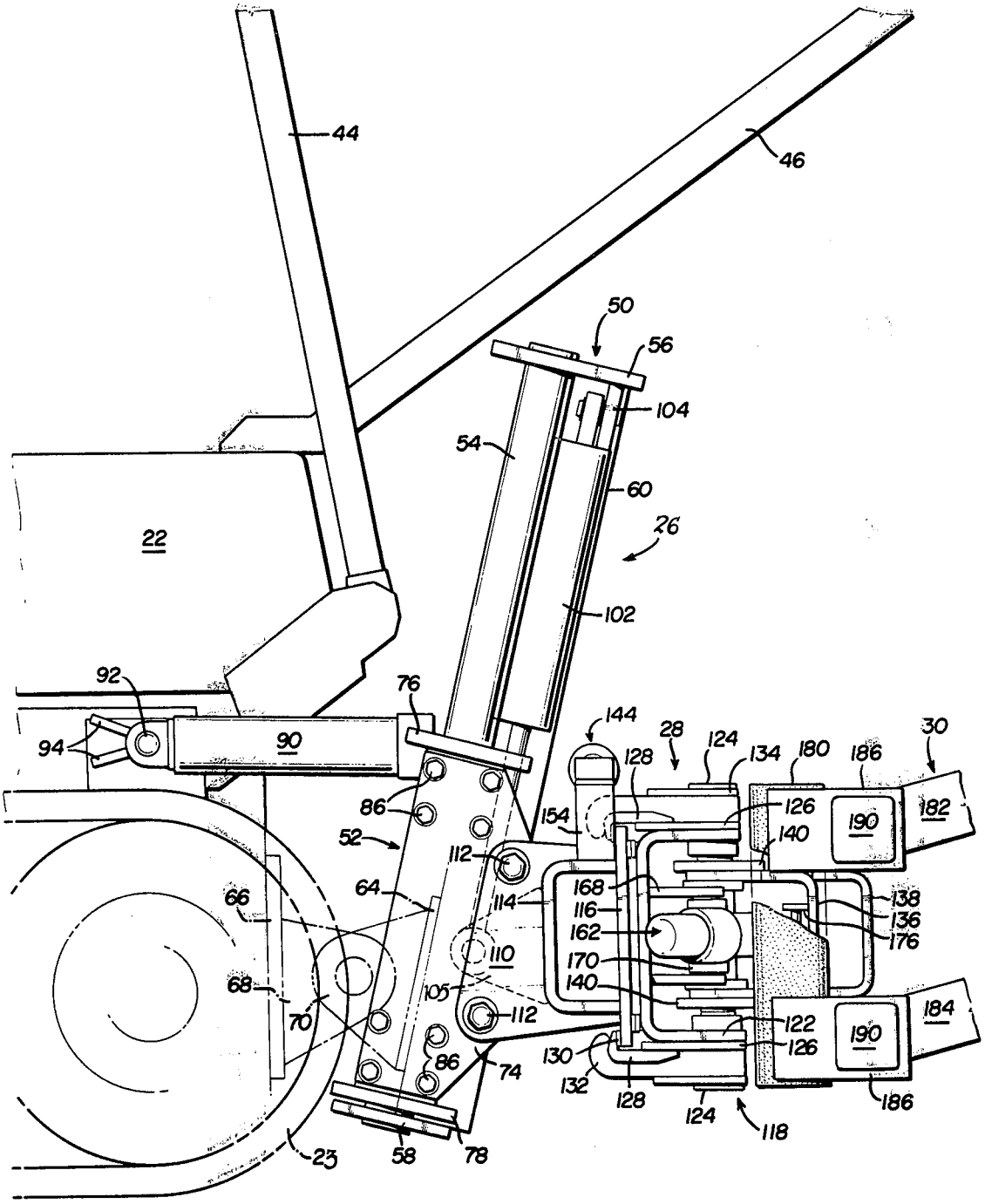
FIG. 2 is an enlarged sided elevation of the mast assembly and control shown in FIG. 1.
Figure 3:
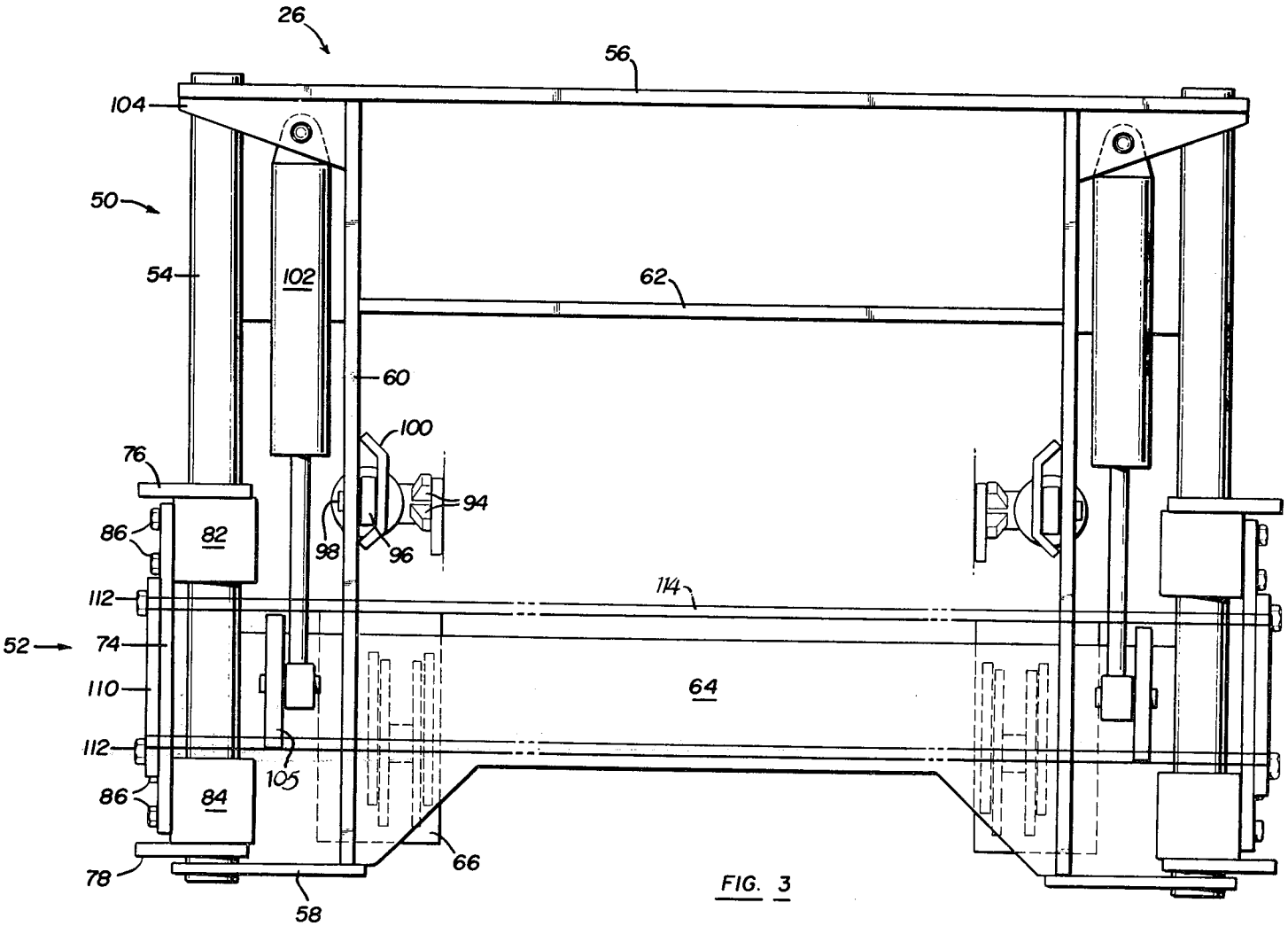
FIG. 3 is a rear elevation of the mast assembly shown in FIGS. 1 and 2.

The mast assembly 26 is shown in detail principally in FIGS. 2 and 3. As shown, the mast assembly 26 generally includes a support frame 50 and a slide frame 52. The support frame includes a pair of generally vertical, laterally spaced, cylindrical rails 54, top and bottom plates 56 and 58, respectively, which secure the rails 54, side plates 60, a reinforcing horizontal plate 62 and a support plate 64. As will be noted, the support and slide frames are formed of a plurality of vertical and horizontal plates, which are preferably steel plates welded together to form a solid supporting structure for the blade. The support frame is pivotally mounted on the prime mover as shown in FIG. 2. The bulldozer includes a plate 66 secured to the bulldozer frame between the tracks 23. A lug 68 is secured to the plate 66 and a mating lug 70 is secured to the support plate 64 of the support frame 50. A suitable bearing or pin is provided between the lugs 68 and 70 to pivotally support the support frame on the prime mover.

Figures 4, 5:
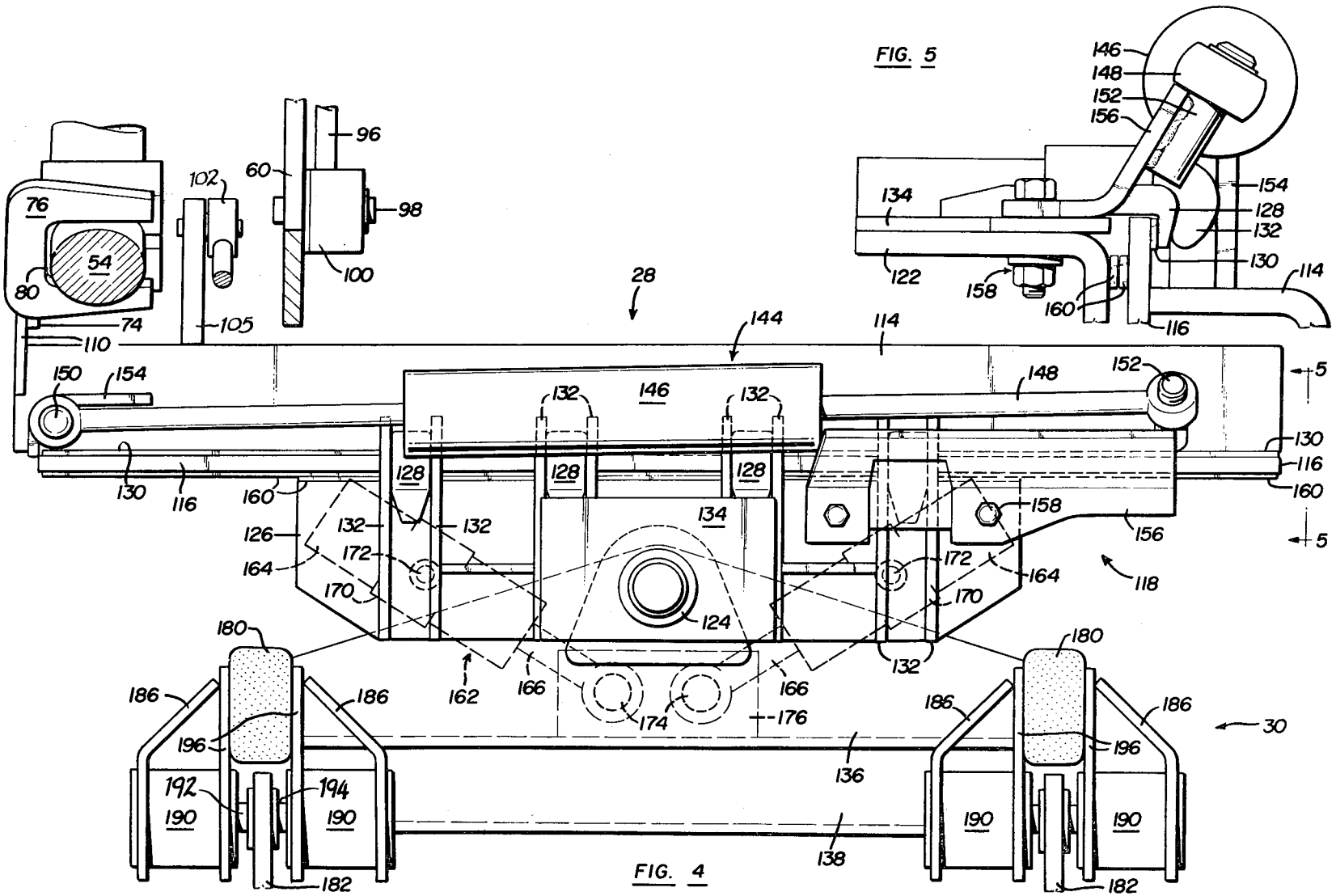
FIG. 4 is a partial top elevation of the side and angle adjustment mechanism disclosed in FIGS. 1 and 2.
FIG. 5 is a partial side view of FIG. 4 in the direction of view arrows 5—5.

The slide frame 52 includes opposed end plates 74, top and bottom collar plates 76 and 78, respectively, having suitable bearings 80 as shown in FIG. 4 and top and bottom box supports 82 and 84, as shown in FIG. 3. The box supports in the disclosed embodiments are bolted by suitable bolts 86 to the end plates 74 and the collar plates 76 and 78 may be welded to the box supports.

The tilting, raising and lowering of the mast assembly is accomplished in the disclosed embodiment by remotely controlled double-acting hydraulic cylinders or pistons. It will be understood, however, that various power means may be utilized. For example, the slide frame 52 may be raised and lowered by a rack and pinion assembly, however, the preferred embodiment includes hydraulic cylinders because of the ease of control and durability of pistons in field applications. In the disclosed embodiment, the tilt adjustment is accomplished by hydraulic pistons 90 which are pivotally mounted on the prime mover by pin 92 on boss 94, as shown in FIG. 2. The extensible piston rods 96 are pivotally secured to the support frame as shown in FIGS. 3 and 4. A pin 98 extends through the upright or vertical plates 60 and clamp plates 100 are provided between the piston rod and the vertical plates. Extension and retraction of pistons 90 thereby adjusts the tilt angle of the mast assembly 26 and thereby the tilt angle of the plow blade, as further described hereinbelow.

The support frame is similarly raised and lowered by double-acting hydraulic pistons 102, which are supported on plates 104 welded to top plate 56. The opposed end of the pistons 102 are pivotally connected to plates 105 of slidable frame member 52. The slide frame member 52 may thus be raised and lowered by retraction and extension of cylinders 102. As described hereinbelow, raising and lowering of slide plate 52 also raises and lowers the plow blade 32.

As described above, the angular and lateral adjustment of blade 32 is accomplished by control mechanism 28. This control is best shown in FIGS. 2, 4 and 5. The control mechanism is supported on the end plates 74 of slide frame 52. Vertical support plates 110 are bolted by bolts 112 to end plates 74 as shown in FIG. 2. The support plates 110 are welded to support channel 114, which structure supports the control mechanism 28 and the tractor plow assembly. The top and bottom edges of vertical plate 116, which is welded to channel 114, form horizontal rails for laterial shifting of the blade assembly. Plates 110 and 116 and channel 114 are referred to herein as the relatively fixed frame assembly and 118 refers to the slide frame assembly.

The slide frame assembly includes a main support channel 122 which is supported on a central cylindrical pivot 124. Plates 126 are welded to the top and bottom of channel 122, for supporting hook-shaped elements 128 which are slidably received on the top and bottom edge of plate 116. In the disclosed embodiment, bearing strips 130 are disposed between the hook-shaped elements 128 and the plate 116. Plates 132 are welded to support plates 126, adding lateral strength to hook-shaped elements 128. End plates 134 are welded to the top surface of plates 132, providing a box-shaped support structure. Rearwardly extending channels 136 and 138 support the blade frame assembly 30, as described hereinbelow.

In the disclosed embodiment, the blade assembly is shifted laterally by a fluid actuated hydraulic piston 144 having a cylinder 146 and piston rod 148. One rod end is connected to pin 150 of the relatively fixed frame assembly and the opposed rod is connected to pin 152 of the slide frame assembly. Support plate or standard 154 retains the rod 150 to channel 114 of the fixed frame assembly and bracket 156 retains the pin 152 to the slide frame assembly, as shown in FIG. 5. In the disclosed embodiment, the bracket is secured to the slide frame assembly by bolts 158 and bearing strips 160 are provided between the support plate 116 and channel 122.

The blade assembly may be angularly adjusted about pivot 124 by actuation of hydraulic pistons 162 having cylinders 164 and piston rods 166 as shown in FIG. 4. Cylinders 164 are pivotally supported within main channel 122 by opposed plates 168, which may be welded to the channel as shown in FIG. 2. The cylinders are received in collars 170 which are supported by pins 172 between the plates 168 as shown in FIG. 4. The piston rods are pivotally connected by pins 174 to horizontal plate 176, which plate forms a part of the frame assembly 30 and which is pivotally supported on vertical pivot 124 as shown in FIG. 4.

Actuation of the pistons 162, by extension of one piston rod and retraction of the opposed piston rod, will therefore result in rotation of the blade frame assembly 30 about vertical pivot 124, providing angle adjustment for the blade assembly.

Figure 6:
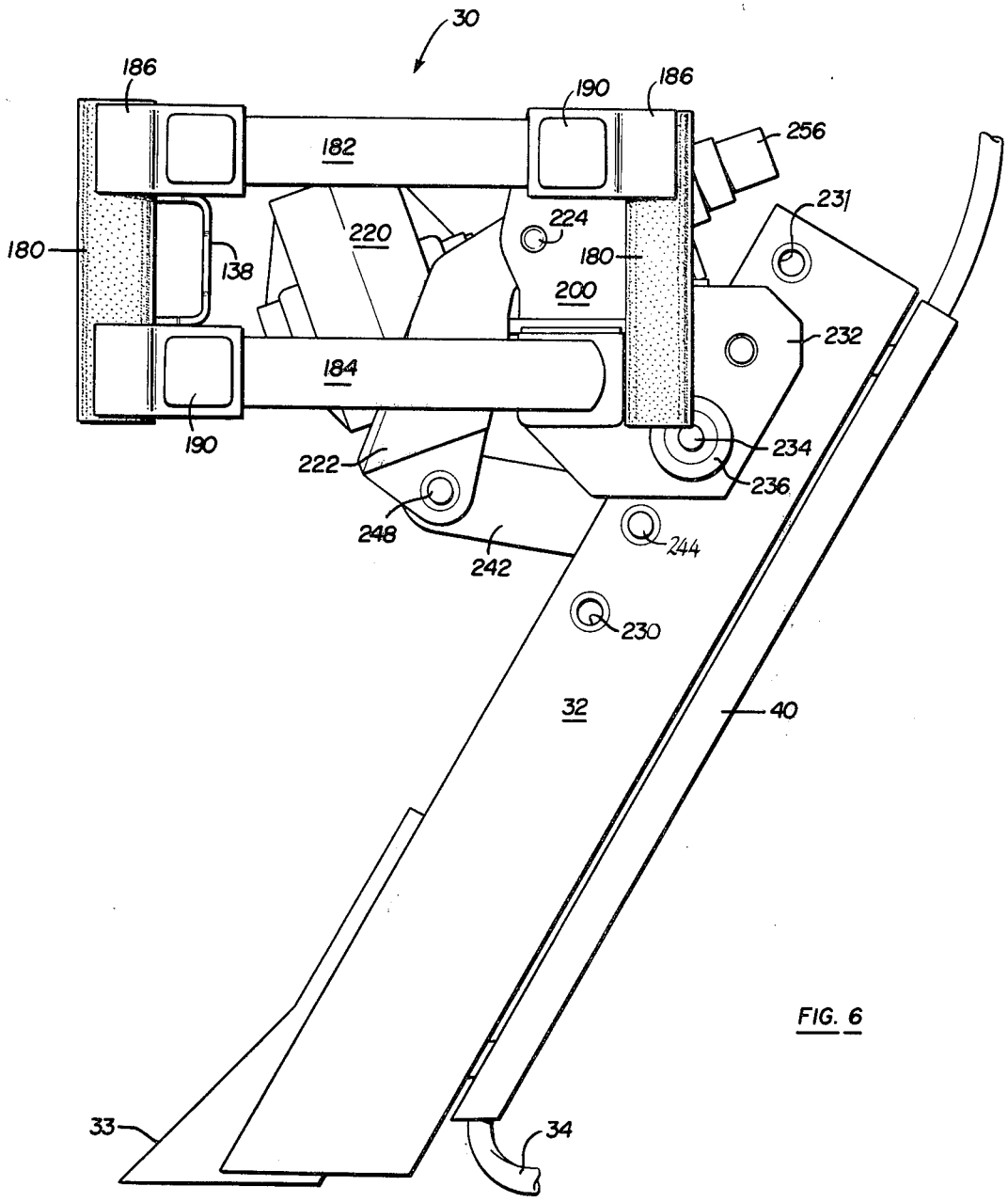
FIG. 6 is an enlarged side elevation of the plow blade and the supporting frame shown in FIG. 1.

The improved frame assembly 30 is shown in FIGS. 6 to 10. As shown in FIG. 6, the frame assembly is supported on channel 138 and plate 176. The frame assembly includes a parallelogram linkage having elastomeric support cushioning elements as described in the above referenced U.S. Pat. No. 3,618,237, which is incorporated herein by reference.

Figure 7:
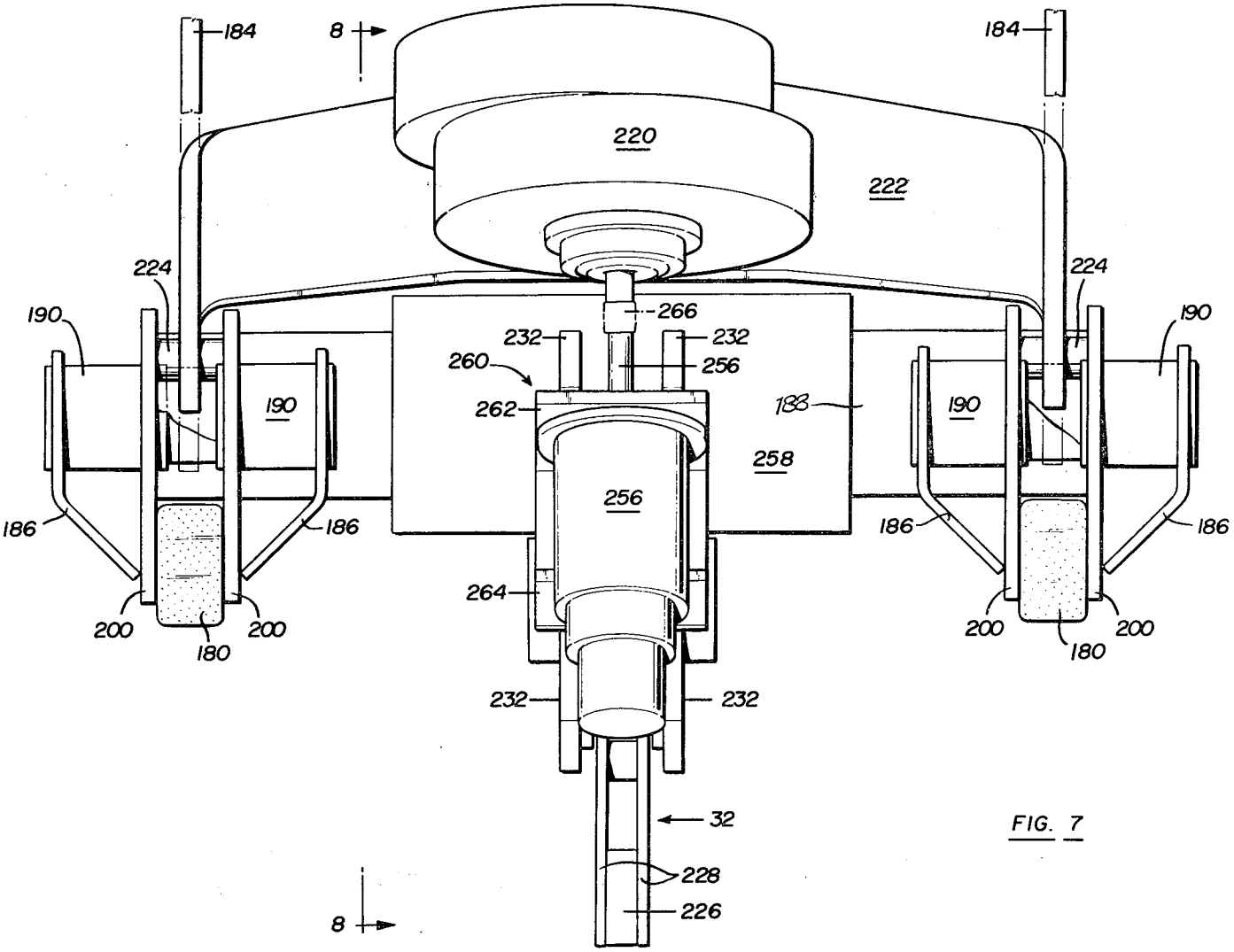
FIG. 7 is a partial top assembly of the blade and support frame shown in FIG. 6.
Figure 8:
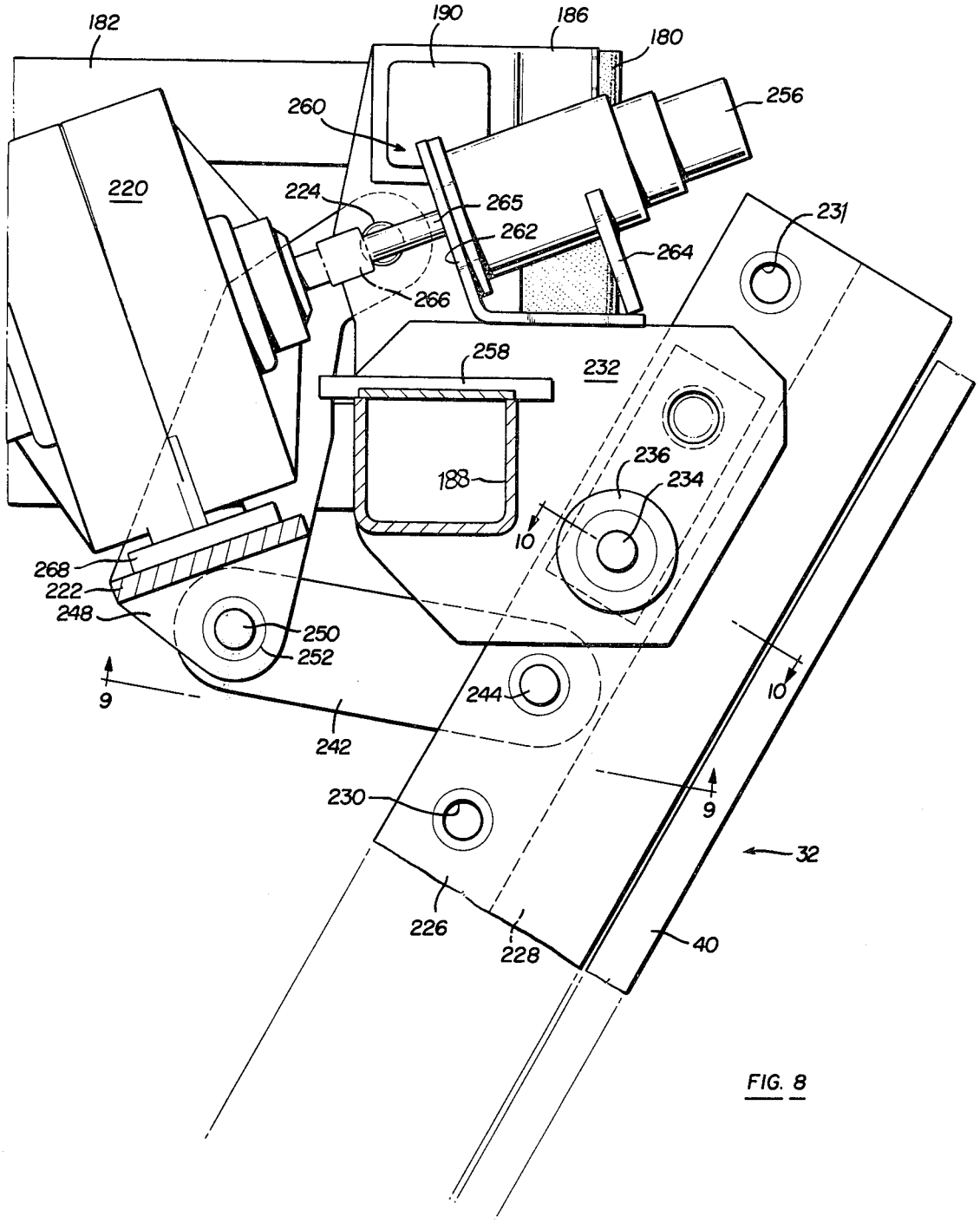
FIG. 8 is a cross-sectional side view of the plow blade and support frame shown in FIG. 7, in the direction of view arrows 8—8.

The parallelogram linkage includes four vertical columns 180, upper side plates 182, lower side plates 184 and a support beam 188 shown in FIGS. 7 and 8. End plates 186 are secured to the side plates by elastomeric torque cushioning elements 190, which elements are rectangular as shown in FIG. 6. The side plates 182 are secured to vertical columns 180 adjacent control mechanism 128 by pins 192 having resilient bushings 194, as shown in FIG. 4. Opposed plates 196 may be welded to vertical columns 180, which plates are secured to torque cushioning elements 190, as shown in FIG. 4 and described in the above-referenced patent. Similarly, support plates 200 may be welded to the rearward vertical columns 180, which plates are supported on torque cushioning elements 190, as shown in FIG. 7. Other details of the parallelogram linkage of the blade support frame may be found in the above-referenced United States patent. This application, however, discloses a unique support for the vibrator and plow blade, which results in orbital or arcuate vibratory motion of the blade, as described hereinbelow.

The vibrator 220 in the preferred embodiment is mounted on a pivotally supported yoke 222. The yoke is supported on plates 200, which in turn are supported on vertical columns 180 as by welding the plates to the columns, as shown in FIG. 7. The opposed ends of the yoke are pivotally supported on pins 224, which preferably include resilient elastomeric bearing elements, not shown. The blade in the preferred embodiment is also pivotally supported on frame 30, as best shown in FIG. 8 and 10. The blade assembly 22 includes a vertical rigid blade 226, cover plates 228 and toe 33, as shown in FIGS. 6 and 10. The blade is pivotally supported on plates 232 by transverse pivot pin 234. Resilient elastomeric bearing elements 236 are received in plates 232 and the bushing 238 between the plates 228 also includes a resilient center bushing. The end plates 228 are bolted to the blade 226, as shown in FIGS. 6 and 8, by rivets or bolts 230.

The yoke 222 is pivotally connected to the blade assembly by link 242, as shown in FIGS. 8 and 9. Line 242 is pivotally connected to the blade by pin 244 which extends between cover plates 228. A resilient elastomeric bushing 246 is provided between the plates 228 and the link 242. Integral lugs 248 are connected to the yoke 222, generally in the axis of the vibrator. The integral lugs are pivotally connected to link 242 by pin 250 and a resilient elastomeric bushing surrounds the pin and extends between the lugs and the link 242.

The vibrator 220 is therefore supported on a four-bar linkage, including link 242, yoke 222, the frame assembly and the blade 32. Vibrations are thus transmitted from the yoke 222, through line 242, to the blade, and the blade is resiliently and pivotally supported on plate 232. The resilient elastomeric bearing 236 permits limited longitudinal movement of the blade and pivotal movement about pin 234, resulting in arcuate or orbital motion of the blade in the ground.

The vibrator or shaker 220 is driven by a suitable motor 256 which is mounted on bracket 260. The bracket may be welded or otherwise secured to plates 232, which plate is welded or otherwise secured on plate 258 and beam 188. The disclosed bracket includes support plates 262 and 264 and the shaft 265 of the motor is connected through universal coupling 266 to the shaker or vibrator. The vibrator 220 may be secured by any suitable means to the yoke 222. In the disclosed embodiment, a suitable mounting plate 268 is provided on the vibrator which is mounted to the yoke.

The disclosed vibrator or shaker 220 is a conventional double-weight vibrator having eccentric weights mounted on a central shaft. The weights are timed to produce vibrations in any preferred axis or plane. The vibrator will normally be timed to produce vibrations perpendicular to the plane of the plate 268, producing the desired orbital motion in the blade 32. One suitable vibrator is sold commercially by Ajax Flexible Coupling Co., of Westfield, N.Y., and disclosed in U.S. Pat. Nos. 1,999,213, 2,097,347 and 2,178,813. The motor may be a conventional hydrostatic fixed displacement motor available from various sources. As disclosed, the general assembly of the various frame elements is composed of a plurality of plates, channels and the like, which may be formed of any suitable material, including conventional structural steel.

The operation of the disclosed vibratory cable-laying plow may be fully understood from the above description of the various figures, however, the following is a brief description of the overall operation. First, the blade assembly 32 may be raised, lowered and tilted by operation of the mast assembly 26, best shown in FIGS. 2 and 3. As will be understood from the description above, the support frame 50 is pivotally supported on plate 66 of the prime mover or vehicle 22. The slide frame assembly 52 is slidably supported on rails 54 which are part of the support frame assembly. The blade assembly 32 is supported on the slide frame assembly as best shown in FIG. 1. Actuation of pistons 102 raises and lowers the slide frame assembly 52 and therefore the blade assembly 32. Actuation of pistons 90 adjust the tilt angle of the mast assembly 26 relative to true vertical, thereby adjusting the tilt angle of the blade assembly. The piston rod 96 of piston 90 may be extended to increase the downward thrust at the rear of the plow blade; forward tilting, resulting from retracion of the piston rod, provides additional lift height of the blade and additional clearance during transport of the vibratory plow. Rearward tilt of the mast assembly also causes the blade to travel slightly to rearward if the plow is raised through use of the vertical lift mechanism. This action is advantageous in that there is less tendency for additional cable to be drawn through the chute or guide 40 as the plow blade is raised, thereby reducing cable damage. Similarly, reverse bending of the cable may be held to a minimum by adjusting the tilt angle of the blade. Forward tilt of the vertical mast may also be used when lowering the plow blade into the ground to protect the cable chute from damage, whereby the chute is tilted away from the ground during entry of the blade. Further, the attack angle of the blade may be varied to compensate for varying soil conditions. And, the depth of the cut of the blade may be varied by lift cylinders 102, without requiring repositioning of the blade with respect to the plow support assembly.

The blade may be caused to track laterally by operation of control mechanism 28. As described, a cable-laying plow is normally rigidly mounted in the longitudinal axis of the prime mover or vehicle 22, however it may be most desirable to move the plow laterally, at times during operation of the cable-laying plow. The disclosed embodiment permits remote operation and control of the lateral position of the blade. The blade may be turned by actuation of pistons 162, best shown in FIGS. 2 and 4.

Extension of one piston rod 166 and retracton of the other causes the frame assembly 30 to pivot about vertical pivot 124, turning the blade 32 relative to the longitudinal axis of the prime mover. The blade may thereby be caused to track the prime mover or follow a separate path by simultaneous action of cylinder 144. As described above, slide frame assembly 118 is slidably supported on plate 162, which plate forms part of the relatively fixed frame assembly supported on the mast assembly 26. Actuation of piston 144 results in lateral motion of slide frame assembly 118 and therefore blade 32. The blade may be shifted laterally, relative to the longitudinal axis of the prime mover 22, prior to entry of the blade in the soil or the blade may be caused to track laterally by simultaneous operation of pistons 162 and 144 while the plow is in the soil and during continuous operation.

As described above, the unique suspension of the blade 32 and vibrator 220 results in an orbital or arcuate motion of the blade toe 33, as shown in FIGS. 6 to 10. The vibrator 220 is suspended on a U-shaped yoke 222 which is pivotally supported on the blade support assembly 30. The blade 32 is pivotally and resiliently supported on the frame assembly and the yoke 22 is pivotally supported to the blade by link 242. This four-bar assembly results in orbital motion of the blade upon actuation of the vibrator or shaker 222.

It will be understood that various modifications may be made to the disclosed vibrator cable-laying plow, particularly in regard to the structural details which have been described herein by way of example. The unique cable-laying plow assembly may be used to remotely tilt, angle, laterally shift, raise and lower the blade assembly and results in an improved orbital motion of the blade. Various modifications of the disclosed assembly may therefore be made to achieve these various purposes and the systems may be utilized independently for the advantages stated.

We claim:

1. A plow, including a vehicle and an elongated vertical blade, the improvement comprising:

a plow positioning assembly, including a support frame having support rails, means for pivotally mounting said support frame to said vehicle, piston means interconnecting said support frame and said vehicle for tilting said support frame, a relatively fixed frame assembly having two vertically spaced rails generally transverse to the longitudinal axis of said vehicle, means for slidably supporting said vertically spaced rails to said support rails for slidable movement of said vertically spaced rails relative to said support rails, a slide frame assembly having slide members slidably supported on said fixed frame assembly rails, a double acting fluid piston interconnected between said fixed and slide frame assemblies for slidably shifting said slide frame generally transverse to the longitudinal axis of said vehicle, said slide frame assembly having a vertical pivot extending between said slide members, a plow frame comprising a plurality of vertical and horizontal frame members, forming a box-like frame assembly, said frame pivotally supported on said vertical pivot and a pair of angularly related fluid pistons, each piston having a cylinder portion pivotally supported by a collar between its ends on said slide frame assembly between said slide members and each said piston having an extensible rod portion pivotally connected to said plow frame, said pistons adjusting the angular relation of said blade relative to said vehicle.

2. The cable laying plow defined in claim 1, characterized in that said rails are defined by the opposed top and bottom edges of a vertical plate and said slide members are defined by opposed hook-shaped elements slidably engaging the top and bottom edges of said vertical plate.

3. The plow defined in claim 1, characterized in that said slidable frame is defined by a channel-shaped plate opening toward said plow frame with said slide elements fixed to the top and bottom surfaces of said channel-shaped plate.

4. The plow defined in claim 3, characterized in that said pair of fluid pistons each include a cylinder pivotally supported within said channel on a yoke and each piston having a rod pivotally connected to said plow frame.

5. A plow, including a vehicle and an elongated plow blade mounted on a blade support, a plow positioning assembly including a generally vertical mast having support rails, means for pivotally mounting said vertical mast to said vehicle, piston means interconnecting said vertical mast and said vehicle for tilting said vertical mast, a vertical slide slidably supported on said mast having laterally spaced side plates fixed to a vertical plate, said vertical plate generally transverse to the longitudinal axis of said vehicle, means for slidably supporting said side plates to said support rails of said vertical mast for slidable movement of said side plates relative to said support rails, piston means interconnecting said vertical mast and said vertical slide for raising and lowering said vertical slide, a lateral slide frame assembly having opposed hook-shaped members engaging the top and bottom edges of said vertical plate and a double acting piston interconnected between said vertical slide and said lateral slide frame for laterally shifting said slide frame, said lateral slide frame having a vertical pivot extending between said hook-shaped members, and a plow frame comprising a plurality of vertical and horizontal frame members forming a box-like frame assembly, said frame pivotally supported on said vertical pivot and a pair of angularly related fluid pistons, each fluid piston having a cylinder portion pivotally supported by a collar between its ends of said slide frame assembly between said hook-shaped members and each said piston having an extensible rod portion pivotally connected to said plow frame to adjust the angular relation of said blade relative to said vehicle.

* * * * *